US011810536B2

(12) United States Patent
Kajimoto

(10) Patent No.: US 11,810,536 B2
(45) Date of Patent: Nov. 7, 2023

(54) INFORMATION PROCESSING APPARATUS AND INFORMATION PROCESSING METHOD

(71) Applicant: DENSO TEN Limited, Kobe (JP)

(72) Inventor: Nobuaki Kajimoto, Kobe (JP)

(73) Assignee: DENSO TEN Limited, Kobe (JP)

( * ) Notice: Subject to any disclaimer, the term of this patent is extended or adjusted under 35 U.S.C. 154(b) by 0 days.

(21) Appl. No.: 17/701,959

(22) Filed: Mar. 23, 2022

(65) Prior Publication Data

US 2023/0178052 A1 Jun. 8, 2023

(30) Foreign Application Priority Data

Dec. 7, 2021 (JP) ..... 2021-198764

(51) Int. Cl.
*G09G 5/395* (2006.01)
*G09G 5/00* (2006.01)

(52) U.S. Cl.
CPC ..... *G09G 5/395* (2013.01); *G09G 5/005* (2013.01); *G09G 2360/127* (2013.01); *G09G 2380/10* (2013.01)

(58) Field of Classification Search
CPC .... G09G 5/395; G09G 5/399; G06F 12/1081; G06F 13/28; G06F 13/32; G06F 2213/28; G06F 11/08; G06F 11/1004
See application file for complete search history.

(56) References Cited

U.S. PATENT DOCUMENTS 11,403,238 B2 * 8/2022 Kinsley ..... G11C 29/52
2018/0182064 A1 * 6/2018 Uehara ..... G06F 3/0656
2018/0293949 A1 * 10/2018 Nakamura ..... G09G 3/3648

FOREIGN PATENT DOCUMENTS

JP 2009-301428 A 12/2009

* cited by examiner

*Primary Examiner* — Antonio A Caschera
(74) *Attorney, Agent, or Firm* — Oliff PLC

(57) ABSTRACT

An information processing apparatus includes: a processor; an image processor to produce an image data for being displayed on a display; and a memory to store a screen data, the screen data being capable of being transferred from the memory to the image processor at a higher transfer rate and a lower transfer rate; wherein, when a new screen data is transferred from the memory to the image processor, the processor sets the lower transfer rate during an interval at which the image processor switches the image data from an old image data to a new image data.

6 Claims, 3 Drawing Sheets

INFORMATION PROCESSING APPARATUS AND INFORMATION PROCESSING METHOD

CROSS-REFERENCE TO RELATED APPLICATION

This application is based on and claims priority under 35 USC 119 from Japanese Patent Application No. 2021-198764 filed on Dec. 7, 2021.

TECHNICAL FIELD

The present disclosure relates to an information processing apparatus and an information processing method.

BACKGROUND ART

Information processing apparatuses may have an on-screen display (OSD) function. The OSD function is a function of further displaying a display region (OSD) on at least a part of a screen of a display device. The OSD is superimposed and displayed on an image provided to a user from an information processing apparatus such as a processing result by the information processing apparatus or an image from a camera, and is used for setting, operation, or the like for the information processing apparatus.

Switching between display and non-display of the OSD, changes in configurations displayed on the OSD, and the like may be performed in a blank period between a drawing period of one screen and a drawing period of a next screen. For the display and non-display of the OSD, the changes in configurations displayed on the OSD, and the like, data from an image storage device that stores data displayed on the OSD may be transferred, by direct memory access (DMA), to an image processing device that processes the OSD.

JP-A-2009-301428 discloses a conventional apparatus.

SUMMARY OF INVENTION

When the display device has a high resolution and a region such as the OSD displayed on the screen has a certain large size, a problem may occur. For example, the display of the region would fail to be in time when the data from the image storage device is not transferred to the image processing device at a data transfer speed corresponding to the screen size.

On the other hand, a data transfer error may be a problem when the data transfer speed from the image storage device to the image processing device is high for in-time display of the region. In particular, problems are likely to occur when a part of data to be displayed in the region is transferred from the image storage device to the image processing device due to configuration changes or the like in the region displayed on the screen.

An aspect of the present disclosure is to suppress a data transfer error during configuration changes or the like in a region while performing data transfer in which the region has a certain large size and may be displayed on a screen of a display device.

A disclosed embodiment is exemplified by an information processing apparatus. The information processing apparatus includes a control unit, an image processing unit, and a storage unit that stores data of a screen to be output to a display unit via the image processing unit. When the image processing unit switches the screen to be output to the display unit, the control unit sets a transfer speed at which the data of the switched screen is transferred from the storage unit to the image processing unit to be lower than a transfer speed at which the data of the screen before the switching is transferred from the storage unit to the image processing unit. Then, the control unit activates the transfer of the data from the storage unit to the image processing unit, and causes the image processing unit to change the screen to be output during a blank period until the switched screen starts to be output to the display unit.

According to an aspect of the present disclosure, there is provided an information processing apparatus including a processor; an image processor to produce an image data for being displayed on a display; and a memory to store a screen data, the screen data being capable of being transferred from the memory to the image processor at a higher transfer rate and a lower transfer rate; wherein, when a new screen data is transferred from the memory to the image processor, the processor sets the lower transfer rate during an interval at which the image processor switches the image data from an old image data to a new image data.

According to the information processing apparatus, it is possible to suppress a data transfer error during configuration changes or the like in a region while performing data transfer in which the region has a certain large size and may be displayed on a screen of a display device.

DETAILED DESCRIPTION OF THE INVENTION

Hereinafter, an information processing apparatus and an information processing method according to an embodiment will be described with reference to the drawings. But, the present invention is not limited to the disclosed embodiment.

First Embodiment (System Configuration)

Figure 1:
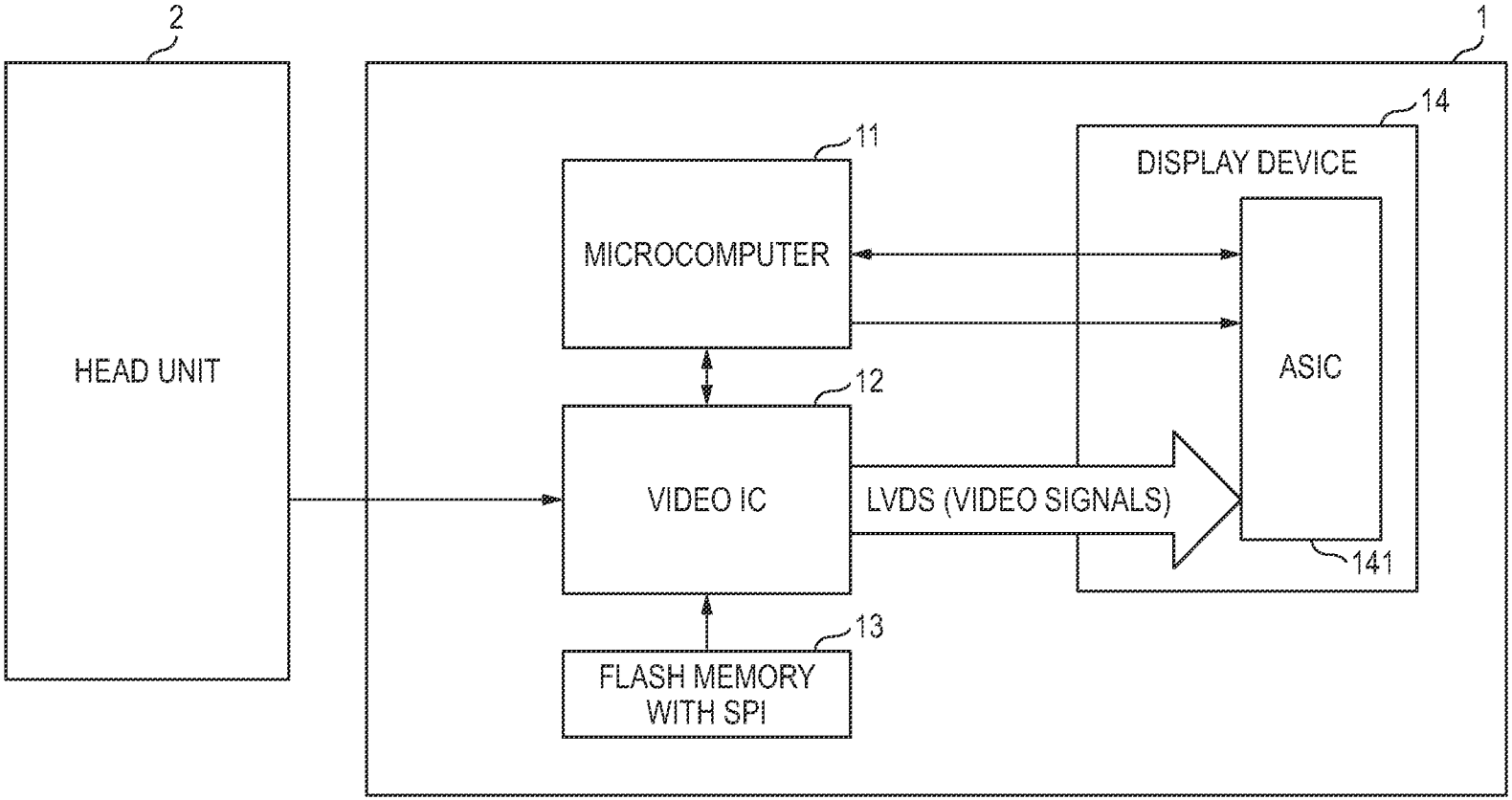
FIG. 1 shows an information processing apparatus according to a first embodiment.

FIG. 1 shows an information processing apparatus 1 according to a first embodiment. FIG. 1 shows a head unit 2 together with the information processing apparatus 1. The information processing apparatus 1 is, for example, an apparatus called a rear seat entertainment system (RSE) mounted on a vehicle. The RSE provides an occupant with contents such as a television broadcast, and video and sound reproduced from a medium such as a digital versatile disc (DVD) at a rear seat of a vehicle interior. The head unit 2 is a device that provides the occupant with video, sound, a navigation function, and the like at a front seat.

As shown in FIG. 1, the information processing apparatus 1 includes a microcomputer 11, a video integrated circuit (hereinafter, referred to as video IC 12), a flash memory with a serial peripheral interface (SPI) (hereinafter, referred to as flash memory 13), and a display device 14.

The microcomputer 11 is called a microcontroller or a microcomputer. The microcomputer 11 includes, for example, a central processing unit (CPU) and a main storage unit. The CPU executes a computer program loaded to be executable in the main storage unit, and provides functions of the information processing apparatus 1. The main storage unit stores the computer program executed by the CPU, data processed by the CPU, and the like. The CPU is also called a processor. The CPU is not limited to a single processor, and may have a multiprocessor configuration. The CPU may be a single processor connected by a single socket, and may have a multi-core configuration. With these processes, the microcomputer 11 receives an operation from a user who is an occupant, and provides various functions to the user in response to the operation from the user. The microcomputer 11 is an example of a control unit.

The video IC 12 cooperates with the microcomputer 11 and provides various contents to the user by the RSE. The video IC 12 outputs, for example, a television broadcast received by the head unit 2 or video reproduced by the head unit 2 to the display device 14. The video IC 12 acquires OSD screen data from the flash memory 13, superimposes the OSD screen data on the received television broadcast, the reproduced video, or the like, and outputs the OSD screen data to the display device 14.

In the present embodiment, the video IC 12 supplies a video signal to the display device 14 by, for example, a low voltage differential signal (LVDS) interface. The interface between the video IC 12 and the display device 14 is not limited to LVDS. For example, the video IC 12 and the display device 14 may be connected by digital RGB, analog RGB, or digital visual interface (DVI). Thus, types of interfaces connected between the video IC 12 and the display device 14 are not limited. The video IC 12 and the display device 14 may be connected by any interface as long as data processed by the video IC 12 can be output to the display device 14. The video IC 12 is an example of an image processing unit.

The flash memory 13 stores the OSD screen data, parameters for changing configurations of the OSD screen data, and the like to be provided to the video IC 12. In the present embodiment, the flash memory 13 communicates with the video IC 12 via the SPI, and provides data such as OSD screen data and parameters to the video IC 12. However, in the present embodiment, a device that stores the OSD screen data, the parameters for changing configurations of the screen data, and the like is not limited to the flash memory 13. The information processing apparatus 1 may include a general nonvolatile memory called an electrically erasable programmable read-only memory (EEPROM) instead of the flash memory 13. The flash memory 13 is an example of a storage unit.

In the information processing apparatus 1 of the present embodiment, the connection between the flash memory 13 and the video IC 12 is not limited to the SPI. The connection between the flash memory 13 and the video IC 12 may be, for example, an inter-integrated circuit (I2C) or peripheral interconnect (PCI) express. The flash memory 13 and the video IC 12 may be connected by a parallel bus. Thus, in the present embodiment, types of the interface or bus connected between the flash memory 13 and the video IC 12 are not limited. The flash memory 13 and the video IC 12 may be connected by any interface or any bus as long as data stored in the flash memory 13 can be transferred to the video IC 12.

The display device 14 displays screen data output from the video IC 12. The display device 14 is, for example, an organic electroluminescent display (OELD) or a liquid crystal display (LCD). The display device 14 includes an application specific integrated circuit (ASIC 141) for display. The ASIC 141 receives a video signal and the like from the video IC 12 and outputs a drive signal for driving the OELD or the LCD.

In the present embodiment, the head unit 2 is not a main component and may be omitted. Further, the information processing apparatus 1 is not limited to the RSE, and may be a television apparatus, a video reproduction apparatus, a sound reproduction apparatus, a personal computer, and the like installed at home. In this case, instead of the head unit 2, a reproducing device such as a DVD or a Blu-ray disc may be connected to the information processing apparatus. The information processing apparatus 1 may be any apparatus that superimposes an OSD on screen data from a device that supplies contents such as the head unit 2 and outputs the OSD and the screen data to a display such as an OELD or a LCD.

Figure 2:
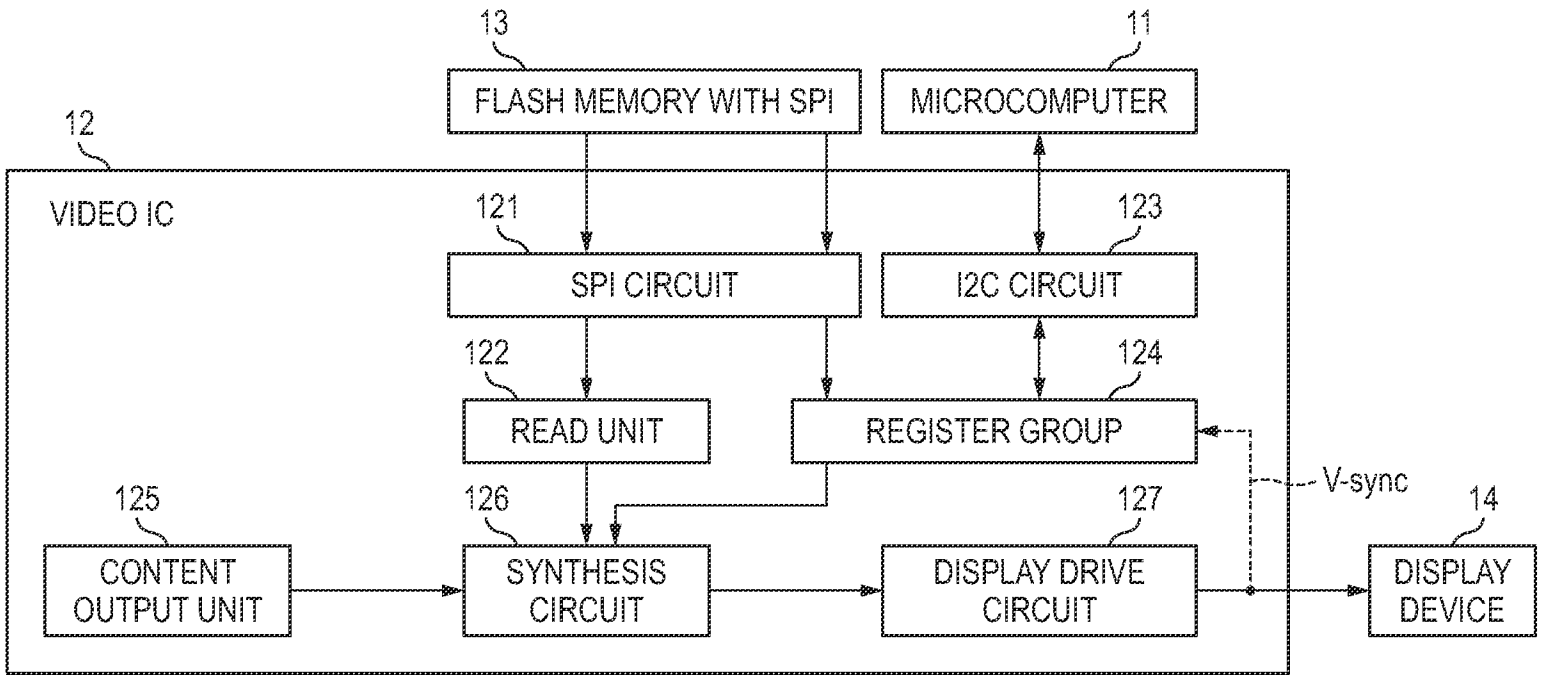
FIG. 2 shows a detailed configuration of a video IC.

FIG. 2 shows a detailed configuration of the video IC 12. FIG. 2 also shows the microcomputer 11, the flash memory 13, and the display device 14. As shown in FIG. 2, the video IC 12 includes a SPI circuit 121, a read unit 122, an I2C circuit 123, a register group 124, a content output unit 125, a synthesis circuit 126, and a display drive circuit 127. Each unit in FIG. 2 is basically a hardware circuit. However, at least a part of the configuration of FIG. 2 may be provided by a program loaded on a memory and a processor.

The SPI circuit 121 communicates with a SPI circuit provided in the flash memory 13 in accordance with an instruction from the read unit 122, and acquires OSD screen data and the like from the flash memory 13. The SPI circuit 121 transfers the data acquired from the flash memory 13 to the read unit 122.

The read unit 122 acquires the data from the flash memory 13 through the SPI circuit 121. The read unit 122 supplies the acquired OSD screen data and the like to the synthesis circuit 126.

The content output unit 125 acquires, for example, video data by television broadcasting or video data reproduced from a DVD or the like (also referred to as content data) from the head unit 2, and supplies the content data to the synthesis circuit 126.

The I2C circuit 123 communicates with the microcomputer 11 and stores setting values from the microcomputer 11 in the register group 124. The register group 124 includes registers that store various control parameters. For example, the register group 124 includes a register for the microcomputer 11 to activate processing by the video IC, a register for specifying a clock frequency when the SPI circuit 121 receives data transferred from the flash memory 13, and a register for specifying configurations of the OSD. The register for specifying configurations of the OSD holds, for example, positions of knobs, switches, volumes, indicators, and the like on the OSD, or setting values such as color.

The flash memory 13 and the SPI circuit 121 transfer data via the SPI at a clock frequency corresponding to a parameter specified in the register for specifying the clock frequency in the register group 124. The synthesis circuit 126 changes configurations of the OSD screen acquired from the read unit 122 in accordance with a parameter or a command of the register group 124.

Among the registers of the register group 124, data is set in at least a part of the register for specifying the configurations of the OSD by direct memory access (DMA) transfer between the video IC 12 and the flash memory 13. With the DMA transfer, data acquired from the flash memory 13 is captured by the register of the register group 124 without interposing the microcomputer 11. The processing of the data transfer from the flash memory 13 to the read unit 122 via the SPI circuit is also a type of processing by the DMA transfer.

However, the data transferred to the read unit 122 is different from capturing data (control parameter) by the register of the register group 124 in that the OSD screen data is captured in block units. For this reason, a data transfer error (also referred to as communication error) is less likely to occur in the data transfer via the read unit 122 even when the data transfer speed from the flash memory 13 is at a certain high level. On the other hand, a data transfer error is likely to occur in data (control parameter) setting of the register of the register group 124. For example, when the display device 14 is a full-high-definition (FHD) display, the data transfer speed from the flash memory 13 is higher than that of a display other than the FHD, and a data transfer error is likely to occur.

In the register group 124, processing of capturing data by the register for specifying configurations of the OSD and changing the screen configurations of the OSD by the synthesis circuit 126 is executed in a blank period in which there is no data output of a display such as the OELD in the display device 14. Here, the blank period is a period between a refresh period in which pixels on the screen are drawn and a next refresh period, and is a period in which elements constituting the pixels on the screen are not driven.

The blank period of the display can be detected by vertical synchronization signals (V-Sync) among signals transmitted from the display drive circuit 127 to the display device 14. Therefore, a part of the vertical synchronization signals (V-Sync) from the display drive circuit 127 are branched and supplied to the register group 124. More specifically, the vertical synchronization signals (V-Sync) are supplied to a control circuit that sets data in the register group 124. The register group 124 is instructed to start and end the blank period detected by the vertical synchronization signals (V-Sync). In the blank period, the synthesis circuit 12 switches the OSD screen, that is, changes the screen configurations of the OSD.

The synthesis circuit 126 synthesizes content data from the content output unit 125 with the OSD screen data and the like supplied from the read unit 122. More specifically, among pixels of the screen occupied by the content data, the pixels of a region occupied by the OSD screen data are replaced with the OSD screen data. In the blank period, the synthesis circuit 126 changes positions or configurations of portions on the OSD in accordance with parameters for specifying portions of the OSD included in the register group 124. The positions or configurations of the portions on the OSD refer to operation states of knobs, buttons, volumes, and the like displayed on the OSD, display states of indicators, and the like.

The synthesis circuit 126 outputs the synthesized data to the display drive circuit 127. The display drive circuit 127 converts screen data synthesized by the synthesis circuit 126 into data conforming to, for example, a LVDS interface, and outputs the data to the display device 14.

Processing Flow

Figure 3:
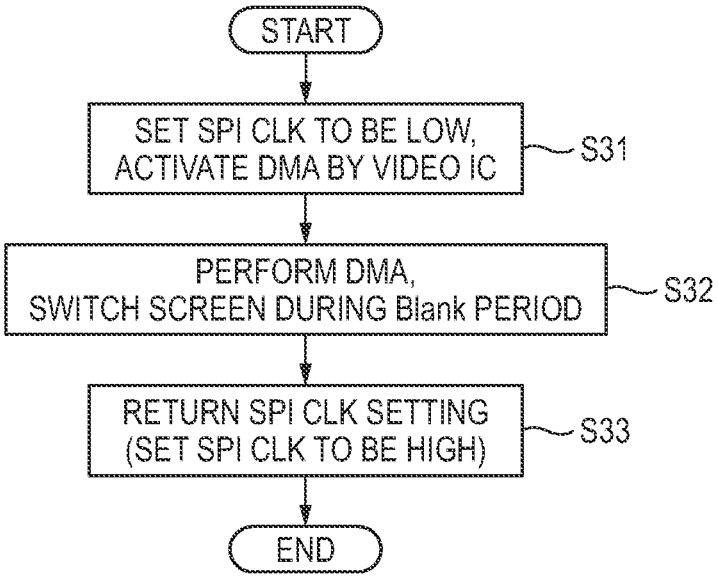
FIG. 3 is a flowchart showing processing of the information processing apparatus.

FIG. 3 is a flowchart showing processing of the information processing apparatus 1 according to the present embodiment. The processing is executed by the microcomputer 11 and the video IC 12. The processing of the video IC 12 is executed by a hardware circuit. The processing of the video IC 12 may also be executed by a processor in accordance with a program on the memory.

In this processing, first, the microcomputer 11 sets a clock frequency in a SPI CLK setting register of the register group 124 to be lower than a current clock frequency via the I2C circuit 123. Then, the microcomputer 11 activates the DMA transfer by the video IC 12 (S31). Here, the current clock frequency is a clock frequency that is sufficiently high for the video IC 12 to acquire the OSD screen data from the flash memory 13 and display the OSD screen data on the display device 14. The current clock frequency is an appropriate value determined from the size of the OSD screen, for example, the length in the horizontal direction and the data amount of one line. The current clock frequency is a clock frequency at the time of normal drawing corresponding to the OSD screen. With the setting of the clock frequency, the data transfer speed between the flash memory 13 and the video IC 12 is determined. The processing in S31 is an example of setting the transfer speed at which data is transferred from the flash memory 13 (storage unit) to the video IC 12 (image processing unit) when the screen is switched to be lower than the transfer speed before the screen is switched. The processing in S31 is also an example of activating the data transfer from the flash memory 13 (storage unit) to the video IC 12 (image processing unit).

On the other hand, the clock frequency lower than the appropriate value set in S31 is a value at which occurrence of a communication error is reduced when the video IC 12 acquires data from the flash memory 13 by DMA and sets the acquired data in the register of the register group. The clock frequency lower than the appropriate value set in S31 is also a clock frequency at which the video IC can normally refresh the OSD screen to the display device 14. Thus, the clock frequency lower than the appropriate value is also a frequency at which the video IC can acquire the OSD screen data from the flash memory 13 and cause the display device 14 to draw the OSD screen during a screen refresh period that is a non-blank period. The data transfer is executed at a transfer speed lower than an appropriate value by the clock frequency lower than the appropriate value. Even when the transfer speed is lower than the appropriate value, the video IC 12 acquires the OSD screen data from the flash memory 13 and causes the display device 14 to normally draw the data. Thus, it can be said that the transfer speed lower than the appropriate value is a transfer speed at which the disturbance of the screen to be output to the display device 14 that is a display unit is suppressed after the setting to the transfer speed lower than the appropriate value. Thus, it can be said that the clock frequency lower than the appropriate value is a small value in a drawable range of the OSD screen, which is determined from the size of the OSD screen, for example, the length in the horizontal direction and the data amount of one line.

Both the clock frequency, which is an appropriate value during the normal operation, and the clock frequency lower than the appropriate value set in S31 may be determined experimentally and empirically. For example, the clock frequency may be experimentally and empirically adjusted and determined based on specifications of the information processing apparatus 1 or an occurrence state of a DMA transfer error in the information processing apparatus 1. A screen on which contents from the head unit 2 or the like are displayed on the display device 14 is referred to as a first screen. The OSD screen can be said to be a second screen superimposed on at least a part of the region of the first screen. It can be said that the transfer speed lower than the appropriate value is set according to the OSD screen, that is, the second screen.

With the setting in S31, the video IC 12 draws the OSD screen with the clock frequency lower than the appropriate value, executes DMA, and switches the screen in a blank period during screen refresh in the display device 14 (S32). The processing in S32 is an example of causing the video IC 12 (image processing unit) to change the screen to be output during the blank period until the microcomputer 11 (control unit) starts to output the switched screen to the display device 14 (display unit).

When the switching of the screen by the video IC 12 is completed, the microcomputer 11 sets an original clock frequency, that is, a clock frequency of a larger appropriate value, in the SPI CLK setting register (S33). The microcomputer 11 determines the completion of the switching of the screen by the video IC based on a value of a register that indicates the completion of the processing included in the register group 124 or the like. The microcomputer 11 may also determine the completion of the switching of the screen by the video IC based on the vertical synchronization signals (V-Sync) in the display device 14. As described above, the information processing apparatus 1 sets the SPI CLK to be smaller than a normal value only at the time of DMA transfer in which a communication error is likely to occur at the time of data transfer from the flash memory 13 to the register group 124. After the DMA transfer, the information processing apparatus 1 returns the SPI CLK to the normal value. As a result, the data transfer is executed between the flash memory 13 and the video IC 12 at the normal SPI CLK, that is, at the normal data transfer speed, except during the DMA transfer.

Figure 4:
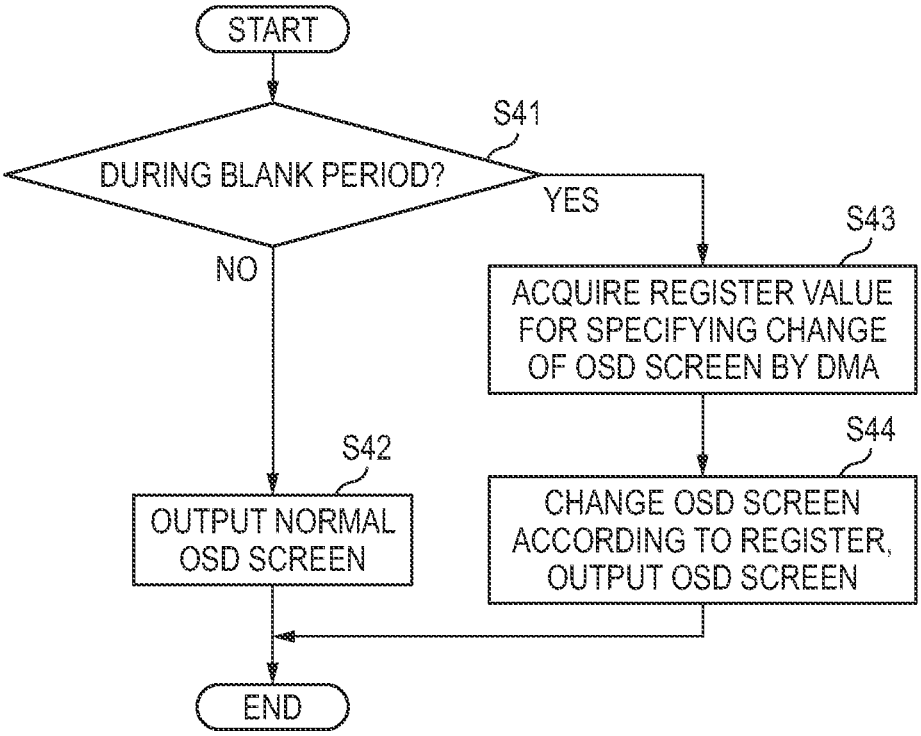
FIG. 4 is a flowchart showing details of DMA transfer and screen switching processing by the video IC.

FIG. 4 is a flowchart showing details of the DMA transfer and the screen switching processing (S32 in FIG. 3) by the video IC. As described with reference to FIG. 3, the processing is executed by a hardware circuit. The processing of the video IC 12 may also be executed by a processor in accordance with a program on a memory.

The processing of FIG. 4 is activated in response to an instruction from the microcomputer 11. At this time, the clock frequency of the SPI is set to a low clock frequency by the setting of the microcomputer 11. When the processing of FIG. 4 is activated, the video IC 12 determines whether the blank period is started from the vertical synchronization signals for driving the display device 14 (S41). When the determination in S41 is not during the blank period (determination of NO), the video IC 12 displays a normal OSD screen (S42). The normal OSD screen is a screen acquired from the flash memory 13, and is a screen in which the configurations in the OSD are not changed. The processing in S43 can be said to be a normal processing executed when there is no change in the OSD screen.

When the determination in S41 is during the blank period (determination of YES), the video IC 12 acquires a register value for specifying a change of the OSD screen by the DMA transfer (S43). The video IC 12 changes the configurations of the OSD screen according to the register value, and outputs the OSD screen to the display drive circuit 127 (S44). Thus, the video IC 12 switches the OSD screen to the changed screen in accordance with the setting of the register during the blank period of the display device 14. This processing can also be referred to as processing of changing the screen to a screen after switching.

Effects of Embodiments

In the information processing apparatus 1 of the present embodiment as described above, the microcomputer 11 sets the clock frequency of the SPI to be lower than the normal appropriate value (normal value) when the configurations of the OSD screen are changed and switched in the processing in S32. For this reason, the DMA transfer from the flash memory 13 is executed at a data transfer speed lower than the normal value. As a result, a data transfer error when setting data in the register of the register group 124 is reduced. Thus, for example, when the configurations of the OSD screen are changed in accordance with an operation of the user, the information processing apparatus 1 can reduce the communication error at the time of data transfer, change the screen during a blank period of the display, and switch to the OSD screen after the change.

In the information processing apparatus 1 of the present embodiment, the clock frequency lower than the normal value can be said to be a small value in a range determined from the size of the screen of the OSD that is the second screen, for example, the length in the horizontal direction and the data amount of one line. For this reason, in the present embodiment, it is possible to set an appropriate clock frequency (normal value) corresponding to the OSD screen and a clock frequency lower than the normal value. In the present embodiment, it is possible to set an appropriate SPI data transfer speed (normal value) corresponding to the OSD screen and a data transfer speed lower than the normal value. In the present embodiment, the information processing apparatus 1 can reduce the data transfer error by setting a slow clock frequency as described above.

In the information processing apparatus 1 of the present embodiment, the video IC can acquire the OSD screen data from the flash memory 13 and display the data on the display device 14 during the screen refresh period that is a non-blank period even at a clock frequency lower than the normal value. Therefore, the information processing apparatus 1 according to the present embodiment can reduce the data transfer error at the time of setting the register due to the change of the OSD screen, suppress the disturbance of the OSD screen, and normally draw the OSD screen.

REFERENCE SIGNS LIST

1 information processing apparatus
2 head unit
11 microcomputer
12 video IC
13 flash memory
14 display device
121 SPI circuit
122 read unit
123 I2C circuit
124 register group
125 content output unit
126 synthesis circuit
127 display drive circuit

What is claimed is:

1. An information processing apparatus comprising:

a microcomputer;

an image processor configured to display an image that comprises an on-screen display (OSD) screen on a display; and a memory that stores OSD screen data and parameters to be used to control the OSD screen, wherein the microcomputer is configured to select, as a data transfer method from the memory to the image processor, either a direct memory access (DMA) transfer or an other data transfer method, and when the microcomputer switches the OSD screen to be displayed on the display, during a blank period at which pixels of the display are not refreshed, the microcomputer selects the DMA transfer as the data transfer method, sets a transfer speed by the DMA transfer to be slower than a transfer speed by the other data transfer method, and transfers the OSD screen data and the parameters from the memory to the image processor to switch the OSD screen.

2. The information processing apparatus according to claim 1, wherein the OSD screen is a second screen superimposed on at least a part of a region of a first screen, and the microcomputer sets the transfer speed by the DMA transfer according to a size of the OSD screen.

3. The information processing apparatus according to claim 1, wherein the transfer speed by the DMA transfer is a transfer speed at which occurrence of a communication error is suppressed when the OSD screen data is transferred from the memory to the image processor.

4. The information processing apparatus according to claim 2, wherein the transfer speed by the DMA transfer is a transfer speed at which occurrence of a communication error is suppressed when the OSD screen data is transferred from the memory to the image processor.

5. The information processing apparatus according to claim 2, wherein the transfer speed by the DMA transfer is a transfer speed at which disturbance of the OSD screen data to be output to the display, after the setting to the transfer speed by the DMA transfer, is suppressed.

6. An information processing method comprising:

displaying an image that comprises an on-screen display (OSD) screen on a display;

storing, in a memory, OSD screen data to be output on the display, and parameters to be used to control the OSD screen;

when switching the OSD screen to be displayed on the display, selecting, during a blank period at which pixels of the display are not refreshed, as a data transfer method for transferring from the memory to an image processor, a direct memory access (DMA) transfer, the DMA transfer being selected from amongst the DMA transfer and an other transfer method;

setting, during the blank period, a transfer speed by the DMA transfer to be slower than a transfer speed by the other data transfer method; and transferring, during the blank period, the OSD screen data and the parameters from the memory to the image processor to switch the OSD screen.

* * * * *